US005806721A

United States Patent [19]

Tada

[11] Patent Number: 5,806,721

[45] Date of Patent: Sep. 15, 1998

[54] CONTAINER MOUNTED PUMP DISPENSER WITH BACK SUCTION

[75] Inventor: Tetsuya Tada, Tokyo, Japan

[73] Assignee: Canyon Corporation, Tokyo, Japan

[21] Appl. No.: 748,605

[22] Filed: Nov. 13, 1996

[30] Foreign Application Priority Data

Dec. 15, 1995 [JP] Japan ..... 7-347118
Feb. 29, 1996 [JP] Japan ..... 8-067430

[51] Int. Cl.[6] ..... B67D 5/42

[52] U.S. Cl. ..... 222/153.13; 222/321.3; 222/321.9

[58] Field of Search ..... 222/321.1, 321.3, 222/321.7, 321.9, 153.13

[56] References Cited

U.S. PATENT DOCUMENTS

| | | | |
|---|---|---|---|
| 3,062,416 | 11/1962 | Cooprider . | |
| 3,228,571 | 1/1966 | O'Donnell et al. | 222/321.9 |
| 3,248,022 | 4/1966 | Schulman et al. | 222/321.9 X |
| 3,359,917 | 12/1967 | Cooprider | 222/321.9 X |
| 3,362,344 | 1/1968 | Duda | 222/321.9 X |
| 3,877,616 | 4/1975 | Stevens | 222/321.9 |
| 4,930,670 | 6/1990 | Kuo . | |
| 5,096,094 | 3/1992 | Guilbert | 222/321.9 X |
| 5,673,824 | 10/1997 | Evans | 222/321.1 X |
| 5,687,878 | 11/1997 | Smith et al. | 222/321.9 X |

FOREIGN PATENT DOCUMENTS

| | | |
|---|---|---|
| 7-6110 | 2/1995 | Japan . |
| 7-96956 | 4/1995 | Japan . |

*Primary Examiner*—Kenneth Bomberg
*Attorney, Agent, or Firm*—Frishauf, Holtz, Goodman, Langer & Chick

[57] ABSTRACT

A push-type dispenser, in which the primary valve has a rod extending in the piston, and the secondary valve is mounted on the primary valve, is provided in the piston and can move in interlock with the primary valve due to the friction between it and the primary valve. A stopper formed on the piston and located above the secondary valve kicks the secondary valve, releasing the secondary valve from interlock with the primary valve and pushing the secondary valve downwards along with the piston. The secondary valve is closed with a delay after the nozzle head and the piston start moving upward. The primary valve is prevented from opening until the secondary valve is closed, thereby to suck the residual liquid back into the cylinder from the nozzle and the piston.

13 Claims, 11 Drawing Sheets

CONTAINER MOUNTED PUMP DISPENSER WITH BACK SUCTION

BACKGROUND OF THE INVENTION

1. Field of the Invention

The present invention relates to a push-type dispenser in which when the nozzle head is pushed down, the piston is reciprocated in a cylinder, sucking up a liquid from a container into the cylinder, pressuring the liquid in the cylinder and discharging the liquid through the nozzle formed integral with the nozzle head.

2. Description of the Prior Art

A so-called push-type dispenser is known which is designed to be coupled to a container containing a relatively viscous liquid such as shampoo or rinse. For example, U.S. Pat. No. 3,062,416 discloses a dispenser of this type. The push-type dispenser comprises a nozzle head with a beak-shaped nozzle, a cylinder and a piston provided in the cylinder. When the nozzle head is pushed down, the piston is reciprocated in the cylinder, sucking up the liquid from the container into the cylinder, pressuring the liquid and discharging the liquid through the nozzle.

The push-type dispenser further comprises a suction tube, a primary valve, and a secondary valve. The suction tube functions a supply path, through which the liquid flows from the container into the cylinder. Formed in the piston and the nozzle is a discharge path, through which the liquid is discharged from the cylinder. The primary valve is arranged in the supply path to regulate the flow of the liquid between the container and the cylinder. The secondary valve is located in the discharge path to regulate the flow of the liquid between the cylinder and the nozzle.

The nozzle head is secured to, and formed integral with, the upper end of the piston A return spring is incorporated in, for example, the cylinder. The return spring applies an upward biasing force on the piston and the nozzle head. Hence, both the piston and the nozzle head are held at their upper (initial) positions.

When a user pushes down the nozzle head from its upper position against the force of the return spring, the piston is also pushed down from its upper position Once the user release the nozzle head, both the nozzle head and the piston move up, returning to their upper positions. As the piston moves upwards, a negative pressure is built up in the cylinder. The liquid is thereby sucked up from the container into the cylinder through the primary valve. When the user pushes down the nozzle head thereafter, the piston moves downwards, pressurizing the liquid in the cylinder. The liquid, thus pressurized, flows from the cylinder to the nozzle head through the discharge path, passing through the secondary valve. The liquid is then discharged from the distal end of the nozzle of the nozzle head.

As disclosed in U.S. Pat. No. 3,062,416, the discharge path for guiding the liquid pressurized in the cylinder to the nozzle of the nozzle head communicates with the interior of the piston and also with the interior of the nozzle. A liquid having a relatively high viscosity, such as shampoo or rinse, would not be completely discharged through the nozzle at one stroke of the piston, even if it is pressurized in the cylinder as the piston moves downwards. Namely, the liquid remains in the discharge path in an amount equal to the volume of the discharge path when the piston is located at its upper position The liquid remaining in the discharge path (i.e., residual liquid) will be forced out from the distal end of the nozzle when the piston is moved down again, causing the pressurized liquid to flow from the cylinder through the secondary valve.

In the conventional push-type dispenser, the secondary valve is dosed by its own weight or by the biasing force of a valve spring, after the liquid is pressurized in the cylinder as the nozzle head is pushed down, moving the piston downwards, and is thereby made to flow from the cylinder into the discharge path through the secondary valve. The primary valve is opened when the piston moves upward from its lower position, generating a negative pressure in the cylinder. As a result, the liquid is sucked up from the container into the cylinder. Since the secondary valve is closed as soon as the liquid flows from the cylinder, and the liquid remains in the discharge path The residual liquid in the discharge path has no way back into the cylinder.

Since the secondary valve with no valve spring rests on the valve seat and can float, it remains open for some time even after the liquid passes through it, because of the relationship among the weight of the secondary valve, the velocity of the liquid and the specific gravity thereof While the secondary valve remains open, the negative pressure in the cylinder draws the residual liquid in the discharge path back into the cylinder. Thus, so called back suction takes place as disclosed in, for example, Unexamined Japanese Patent Application Publication No. 7-096956/95. Since back suction depends on the weight of the secondary valve and the viscosity and specific gravity of the liquid, back suction cannot be accomplished with high reliability.

In general, the nozzle is always open at its distal end, and the residual liquid reaches a point a little behind the distal end of the nozzle. The residual liquid is very likely to dribble down from the distal end of the nozzle, particularly when the nozzle head is inclined downwards.

Furthermore, the residual liquid is exposed to air at the distal end of the nozzle. Its foremost part is likely to dry and solidify, clogging the distal end of the nozzle. Once the distal end of the nozzle is clogged, the liquid can no longer be smoothly discharged through the nozzle, most probably impairing the use of the push-type dispenser.

As disclosed in, for example, Examined Japanese Utility Model Application Publication No. 7-6110/95, a mechanism is known which generates a negative pressure in the piston as the piston moves upwards. The mechanism has a solid rod member which extends from the cylinder into the piston. As the piston moves upwards, the space which the rod member occupies in the cylinder decreases gradually, whereby a negative pressure is generated in the piston The negative pressure thus generated draws the residual liquid from the discharge path back into the cylinder. The rod member is indispensable to the mechanism and the rod member needs to be secured in the cylinder. The mechanism is inevitably complex in structure.

SUMMARY OF THE INVENTION

It is an object of the present invention to provide a push-type dispenser in which back suction is reliably achieved by a simple mechanism to prevent a liquid from remaining in the distal portion of the nozzle, thereby ensuring smooth discharge of the liquid.

In the conventional push-type dispenser, the ti of closing the secondary valve after the liquid has flowed from the cylinder cannot be adjusted automatically. This is because the timing depends on unreliable factors, i.e., the weight of the secondary valve, the viscosity of the liquid and the specific gravity thereof.

In a push-type dispenser according to the present invention, the secondary valve is held open some time after the piston starts moving upwards, and the primary valve is opened some time after the secondary valve is closed. That is, the secondary valve is closed with a delay after the piston starts moving up, and the primary valve is opened with a delay after the secondary valve is closed. The residual liquid therefore flows back into the cylinder through the secondary valve before the primary valve is opened, due to the negative pressure generated in the cylinder by the upward motion of the piston. In short, back suction is accomplished.

According to one embodiment of the present invention, there is provided a push-type dispenser in which the primary valve is shaped like a rod, extending in the piston, the secondary valve is provided in the piston, surrounding the primary valve, and a stopper is located above the secondary valve. The secondary valve has a seal member on its inner surface. The seal member is set in sliding contact with the primary valve. Hence, the secondary valve operates in interlock with the primary valve. The stopper kicks the secondary valve, releasing the secondary valve from the interlock with the primary valve and allowing the same to move downwards together with the piston.

With this structure, the primary valve holds the secondary valve, spacing the same from the valve seat, and remains pushed onto the valve seat by the pressurized liquid as long as the nozzle head is pushed downwards, thus holding the piston at the lower position. Thus, the primary valve and the secondary valve remain closed and opened, respectively, while the piston stays at the lower position. The secondary valve remains opened until the valve seat abuts on it, even after the user releases the nozzle head, thus moving the piston upwards. After the valve seat abuts on the secondary valve and closes the secondary valve, the primary valve is opened. The liquid therefore flows into the cylinder through the primary valve.

DETAILED DESCRIPTION OF THE PREFERRED EMBODIMENTS

Embodiments of this invention will be described in detail, with reference to the accompanying drawings.

Figure 1:
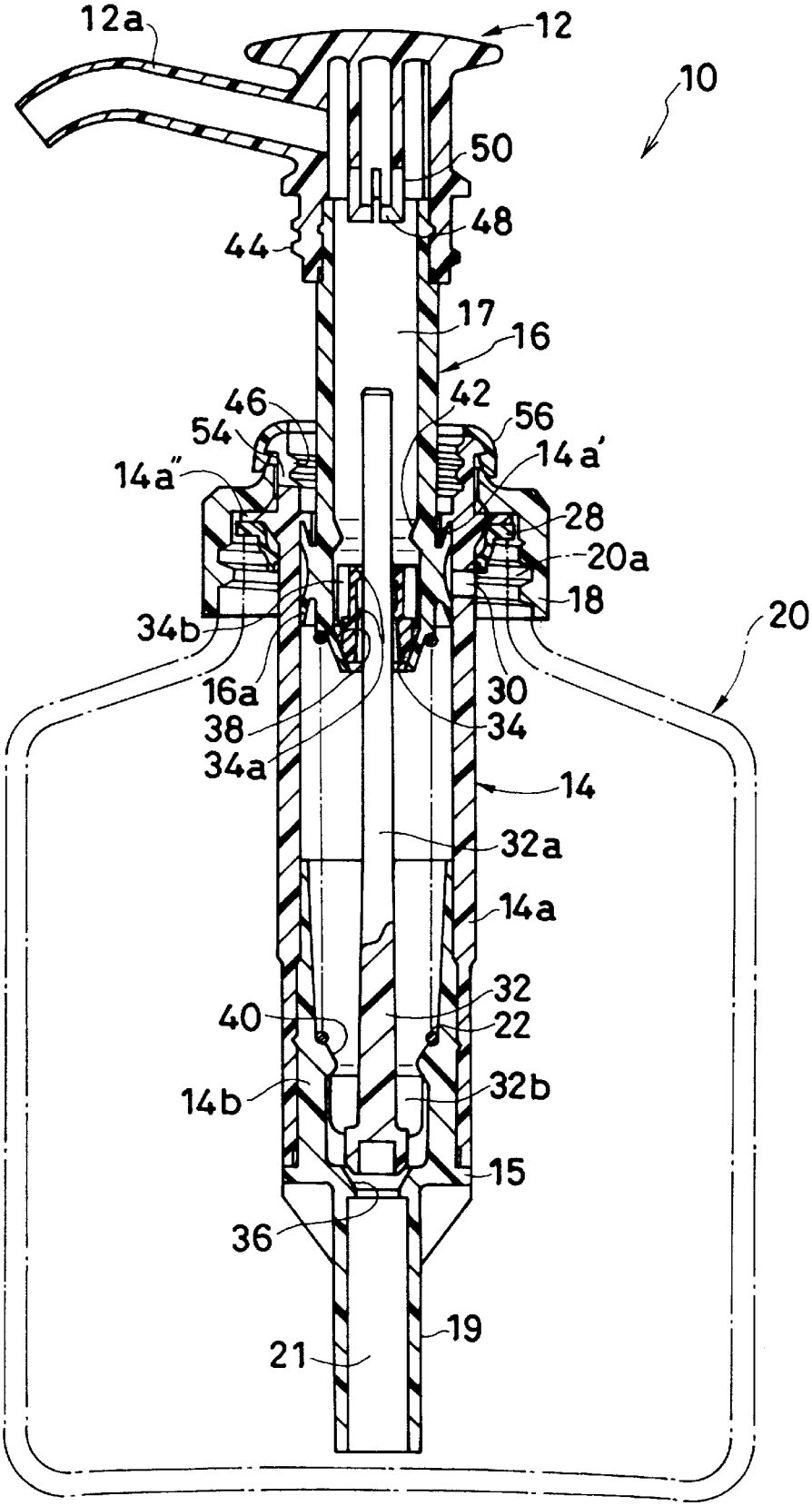
FIG. 1 is a longitudinal sectional view of a push-type dispenser according to a first embodiment of the present invention, showing the nozzle head located at its upper (initial) position.

FIG. 1 shows a push-type dispenser 10 according to the first embodiment of the present invention As shown in FIG. 1, the dispenser 10 comprises a nozzle head 12, a cylinder 14 and a piston 16. The piston 16 is provided in the cylinder 14 and can reciprocate. The nozzle head 12 has a beak-shaped nozzle 12*a,* which is formed integral with the main body. The dispenser 10 is removably coupled to the mouth 20*a* of a container 20 by means of a rotatable bottle cap 18. As the piston 16 reciprocates in the cylinder 14, the liquid contained in the container 20 is sucked up into the cylinder 14, pressurized therein, and discharged from the distal end of the nozzle 12*a* of the nozzle head 12.

Examples of the container 20 are a container filled with a relatively viscous liquid such as shampoo, rinse or hand soap and a container filled with viscous food such as mayonnaise, tomato catsup or Worcestor sauce. The container 20 is made of plastics or glass.

As shown in FIG. 1, the piston 16 has a skirt-shaped seal member 16*a*. The seal member 16*a* is composed of a pair of seal pieces formed integral with the lower end portion of the piston 16. It slides on the inner circumferential surface of the cylinder 14 as the piston 16 moves up and down The nozzle head 12 is secured to the upper end of the piston 16. The nozzle head 12 therefore moves up and down as the piston move so in the cylinder 14.

A discharge path 17 extends through the piston 16 and the nozzle head 12. It is through the discharge path 17 that the liquid can flow from the cylinder 14.

The cylinder 14 is composed of a main body 14*a* and a valve base 14*b*. The main body 14*a* is a hollow cylinder. The valve base 14*b* has a bottom and fixed to the lower end of the main body 14*a*. As seen from FIGS. 1 and 2, the valve base 14*b* has a flange 15 on its lower end. The flange 15 functions as a stopper fixing the valve base 14*b* to the lower end of the main body 14*a*.

To reduce the number of components of the dispenser, thereby to simplify the structure thereof a suction tube 19 is formed integral with the lower end of the valve base 14*b*. The suction tube 19 defines a supply path 21 through which the liquid is sucked up from the container 20 into the cylinder 14.

As illustrated in FIG. 1, a return spring 22 such as a compression coil spring, is provided in the cylinder 14, interposed between the piston 16 and the valve seat formed on the inner circumferential surface of the valve base 14*b*. The return spring 22 keeps pushing up the piston 16 and, hence, the nozzle head 12. The seal member 16*a* is thereby held in contact with an annular member 14*a*' provided in the inner circumferential surface of the upper end portion of the cylinder 14. Also, the nozzle head 12 is at its upper position (i.e., initial position). All components of the dispenser 10, except the return spring 22, are made of plastics so that the nozzle head 12, cylinder 14, piston 16 and the like may be recycled.

Figure 3:
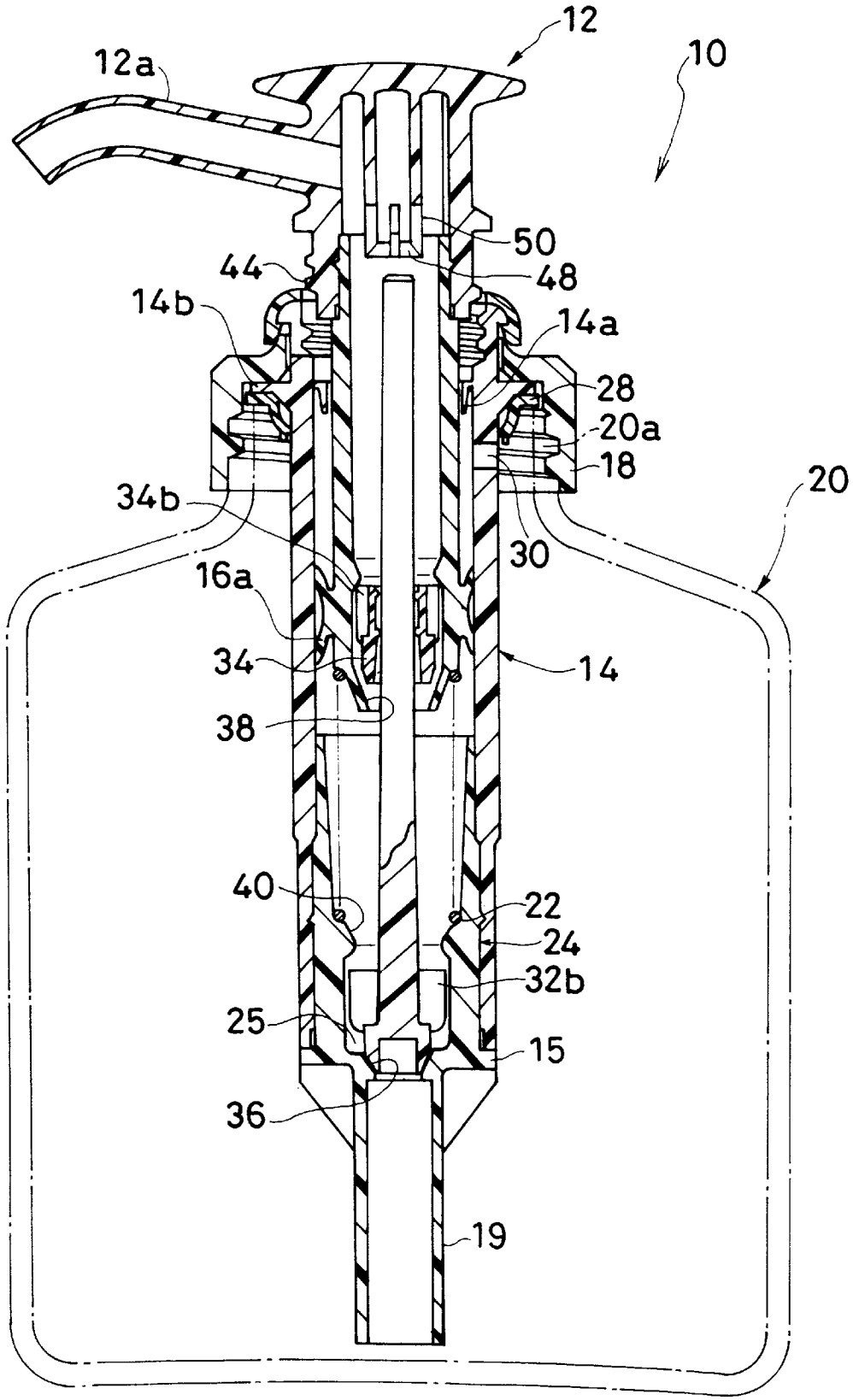
FIG. 3 is a longitudinal sectional view of the first embodiment, showing the nozzle head located at its lower position.

When a user pushes down the nozzle head 12 against the biasing force of the return spring 22 to the position shown in FIG. 3, the piston 16 is moved downwards in the cylinder 14. When the user releases the nozzle head 12, the piston 16 is pushed up by the return spring 22. Both the piston 16 and the nozzle head 12 therefore return to their respective upper positions shown in FIG. 1. Thus, the piston 16 reciprocates between the upper position (FIG. 1) and the lower position (FIG. 3), performing a so-called "pumping action."

The bottle cap 18 is set in screw engagement with the mouth 20*a* of the container 20. Interposed between the cap 18 and the mouth 20*a* are a packing 28 and a flange 14*a*", which is formed integral with the cylinder 14. The dispenser 10 is thereby removably coupled to the container 20 in watertight fashion.

The cylinder 14 has at least one vent hole 30. The vent hole 30 is provided to prevent a negative pressure from being generated in the container 20 when the liquid is sucked up from the container 20 into the cylinder 14.

The dispenser 10 has a primary valve 32 and a secondary valve 34 which are provided in the supply path 21 and the discharge path 17, respectively. The primary valve 32 regulates the flow of the liquid in the supply path 21. The secondary valve 34 regulates the flow the liquid in the discharge path 17.

As shown in FIG. 1, the inner circumferential surface of the lower end portion of the valve base 14*b* flares upwards, defining a valve seat 36. The primary valve 32 rests on the valve seat 36 in the cylinder 14. The inner circumferential surface of the lower end portion of the piston 16 flares upwards, defining a valve seat 38. The secondary valve 34 can rest on the valve seat 38, in the piston 16.

As understood from FIG. 1, the primary valve 32 has a rod 32*a* extending through both the cylinder 14 and the piston 16. The secondary valve 34 is a hollow cylinder surrounding the rod 32*a*. Two seal members 34*a* are provided in the inner circumferential surface of the secondary valve 34 and mounted on the rod 32*a*. The secondary valve 34 is connected to the rod 32*a* by virtue of the friction between either seal member 34*a* and the rod 32*a*. Therefore, the secondary valve 34 moves up and down when the primary valve 32 is moved so. The seal members 34*a* connect the secondary valve 34 to the rod 32*a* in watertight fashion.

The seal members 34*a* are shaped like a ring and spaced apart from each other in vertical direction. They may be replaced by skirt-shaped ones similar to the seal member 16*a* which is formed integral with the lower end portion of the piston 16. Furthermore, the number of seal members 34*a* is not limited to two. Only one seal member 34*a* or three or more seal members may be used, provided that the friction between the seal member or members 34*a* and the rod 32*a* is large enough to make the secondary valve 34 move up and down together with the primary valve 32.

A plurality of guide plates 32*b* are provided on the outer circumferential surface of the primary valve 32, extending in radial direction of the valve 32 and spaced apart at angular intervals. The guide plates 32*b* prevent the primary valve 32 from tilting in the cylinder 14. Similarly, a plurality of guide plates 34*b* are provided on the outer circumferential surface of the secondary valve 34, extending in radial direction of the valve 34 and spaced apart at angular intervals. The guide plates 34*b* prevent the secondary valve 34 from tilting in the cylinder 14.

A stopper 40 is formed integral with the inner surface of the valve base 14*b*. The stopper 40 is located above the valve seat 36, preventing the primary valve 32 from moving upwards. A stopper 42 is formed integral with the inner surface of the piston 16. The stopper 42 is located above the valve seat 38, preventing the secondary valve 34 from moving upwards. The stopper 40 serves as a seat for the return spring 22. The stopper 42 kicks the secondary valve 34 when the piston 16 moves downwards, allowing the secondary valve 34 to move down independently of the primary valve 32, as will be later explained in detail.

As described above, the seal members 34*a* are set in frictional contact with the primary valve 32 and the secondary valve 34 surrounds the rod 32*a* (i.e., the primary valve 32). Hence, the piston 16 moves down when the nozzle head 12 is pushed down from the upper position (FIG. 1) against the biasing force of the return spring 22, not accompanied by the secondary valve 34 until the stopper 42 abuts on the guide plates 34*b* and kicks the secondary valve 34.

When the stopper 42 abuts on the guide plates 34*b* and kicks the secondary valve 34, the secondary valve 34 is released from the interlock with the primary valve 32. The secondary valve 34 can now move down, independently of the primary valve 32. The piston 16 therefore moves downwards to its lower position (FIG. 3), together with the secondary valve 34 sliding down on the rod 32*a* (i.e., the primary valve 32).

Thus, the secondary valve 34 starts moving downwards upon lapse of some time from the start of the downward motion of the piston 16. In other words, the piston 16 moves down, not accompanied by the secondary, immediately after the user pushes the nozzle head 12.

When the user releases the nozzle head 12 after the piston 16 is moved down to the lower position shown in FIG. 3, the nozzle head 12 is pushed up together with the piston 16, due to the biasing force that applies on the piston 16. The piston 16 moves up, not accompanied by the secondary valve 34, until the valve seat 38 (i.e., the lower end of the piston 16) abuts on the secondary valve 34. Thereafter, the piston 16 moves upwards, accompanied by the secondary valve 34. That is, the secondary valve 34 is not closed when the piston 16 starts moving upwards; it remains opened until the valve seat 38 abuts against it. To state it another way, the secondary valve 34 is closed with a delay after the piston 16 begins to move upwards.

In a conventional push-type dispenser, the secondary valve is opened at substantially the same time as the piston is pushed down, and is closed at virtually the same time as the piston starts moving upwards. In the push-type dispenser shown in FIG. 1 to 4, the secondary valve 34 is opened at almost the same time as the piston 16 is pushed down, but is closed upon lapse of some time from the start of the upward motion of the piston 16.

When the nozzle head 12 is pushed down from the upper position (FIG. 1), moving the piston 16 downwards, the liquid in the cylinder 14 is pressurized. The primary valve 32 is thereby pressed onto the valve seat 36 and closed. The primary valve 32 holds the secondary valve 34, which would not move down at all till the piston 16 is further moved downwards. This means that the secondary valve 34 is opened at substantially the same time as the piston 16 moves downwards.

When the stopper 42 formed integral with the inner surface of the piston 16 abuts on the guide plates 34*b*, thus kicking the secondary valve 34, the piston 16 further moves downwards, accompanied by the secondary valve 34, while the seal members 34*a* of the valve 34 is sliding on the primary valve 32. Moving down this way, the piston 16 further pressurizes the liquid in the cylinder 14.

Since the piston 16 further moves down after opening the secondary valve 34, the liquid flows into the discharge path 17 through the secondary valve 34 The liquid forces the residual liquid out from the discharge path 17 and finally from the nozzle 12*a*. Not only the residual liquid, but also a part of the liquid sucked up into the path 17 is discharged from the nozzle 12*a*. The remaining part of the liquid sucked into the path 17 fills up the discharge path 17 and remains therein.

As described above, the piston 16 moves upwards, not accompanied by the secondary valve 34, until the valve seat 38 abuts on the secondary valve 34 to close the secondary valve. That is, the secondary valve 34 is closed with a delay. During this delay, a negative pressure is generated in the cylinder 14 as the piston 16 moves up. The negative pressure forces the residual liquid in the discharge path 17 back into the cylinder 14 through the secondary valve 34.

When the valve seat 38 abuts on the secondary valve 34, the secondary valve 34 is closed as shown in FIG. 1. As the piston 16 further moves up, accompanied by the secondary valve 34 thus closed, the negative pressure in the cylinder 14 pushes the primary valve 32 away from the valve seat 36, whereby the primary valve 32 is opened. As a result, the liquid is sucked up from the container 20 into the cylinder 14 through the suction tube 19 and the primary valve 32.

When the nozzle head 12 and the piston 16 start moving up, a part of the residual liquid in the discharge path 17 is forced back into the cylinder 14 before the liquid is sucked up from the container 20 into the cylinder 14 Namely, so-called back suction takes place when the nozzle head 12 and the piston 16 begins to move upwards. As the part of the residual liquid in the piston 16 flows back into the cylinder 14, the residual liquid in the nozzle 12 flows back from the distal end thereof Therefore, the foremost part of the residual liquid is not directly exposed to air, prevented from drying or solidifying. The liquid can therefore be discharged smoothly.

Since the foremost part of the residual liquid does not exist near the distal end of the nozzle 12*a,* the liquid never dribble from the nozzle 12*a*. As shown in FIG. 1, the proximal end portion of the nozzle 12*a* is inclined upward, while the distal end portion is inclined downwards. Obviously, the liquid can be more reliably prevented from dribbling if the residual liquid is forced back until its foremost part passes the junction between the proximal and distal end portions of the nozzle 12*a*.

The opening of the secondary valve 34 is delayed for some time after the piston 16 starts moving upwards. Hence, back suction can be reliably achieved, free of the influence of the weight of the secondary valve 34, the viscosity of the liquid and the specific gravity of thereof The primary valve 32 is shaped like a rod and the secondary valve 34 is mounted on the primary valve 32 and set in frictional contact with the primary valve 32. This simple structure makes it possible to close the secondary valve 34 with a delay from the start of the upward motion of the nozzle head 12 and to open the primary valve 32 with a delay after the secondary valve 34 is closed.

The upper end of the primary valve 32 is present in the piston 16, no matter whether the nozzle head 12 assumes its upper position (FIG. 1) or its lower position (FIG. 3). Nonetheless, the primary valve 32 occupies a smaller space in the piston 16 at the time the nozzle head 12 moves upward than at the time the nozzle head 12 stays at the lower position, as clearly seen by comparing FIGS. 1 and 3. Since the upper half of the secondary valve 34 exists in the piston 16, the space the primary valve 32 occupies in the piston decreases as the nozzle head 12 moves upwards. A negative pressure is thereby generated in the piston 16, drawing the residual liquid from the nozzle 12*a* back into the piston. Back suction is caused by the decrease of the space occupied by the primary valve 32 in the piston, in addition to the back suction attained by the delay of the opening of the secondary valve 34

Since the upper half of the primary valve 32 (i.e., the rod 32*a*) exists in the piston 16, no other member is required to generate a negative pressure in the piston 16. Furthermore, no mechanism is required to fix the rod 32*a* in the cylinder 14, because the primary valve 32 is pressed onto the valve seat 36 and held on it when a negative pressure is generated in the cylinder 14. The dispenser 10 is therefore relatively simple in structure.

The nozzle head 12 has a male screw 44 on its outer circumferential surface. On the other hand, the cylinder 14 has a female screw 46 on the inner circumferential surface of its upper end portion. The male screw 44 and the female screw 46 can mesh with each other by pushing the nozzle head 12 down further from its lower position (FIG. 3), abutting the male screw 44 onto the female screw 46, any by turning the nozzle head 12. As a result, the nozzle head 12 is held at its lowest position, decreasing the height of the dispenser 10 or the height of the unit comprising the dispenser 10 and the container 20. This helps to reduce the space the dispenser 10 or the dispenser-container unit occupies while being transported or displayed.

A valve holder 48 is formed integral with and suspended from the inner surface of the top of the nozzle head 12. The valve holder 48 receives and holds the upper end portion of the primary valve 32 when the nozzle 12 is pushed to its lowest position The holder 48 is a hollow cylinder and has a plurality of vertical slits 50. The slits 50 opens at the lower end of the holder 48 and spaced apart along the circumference of the holder 48 at angular intervals. The valve holder 48 can therefore elastically expand and contract in the radial direction As the valve holder 48 is gradually mounted on the upper end portion of the primary valve 32, its lower end portion elastically expands to hold the primary valve 32.

Figure 4:
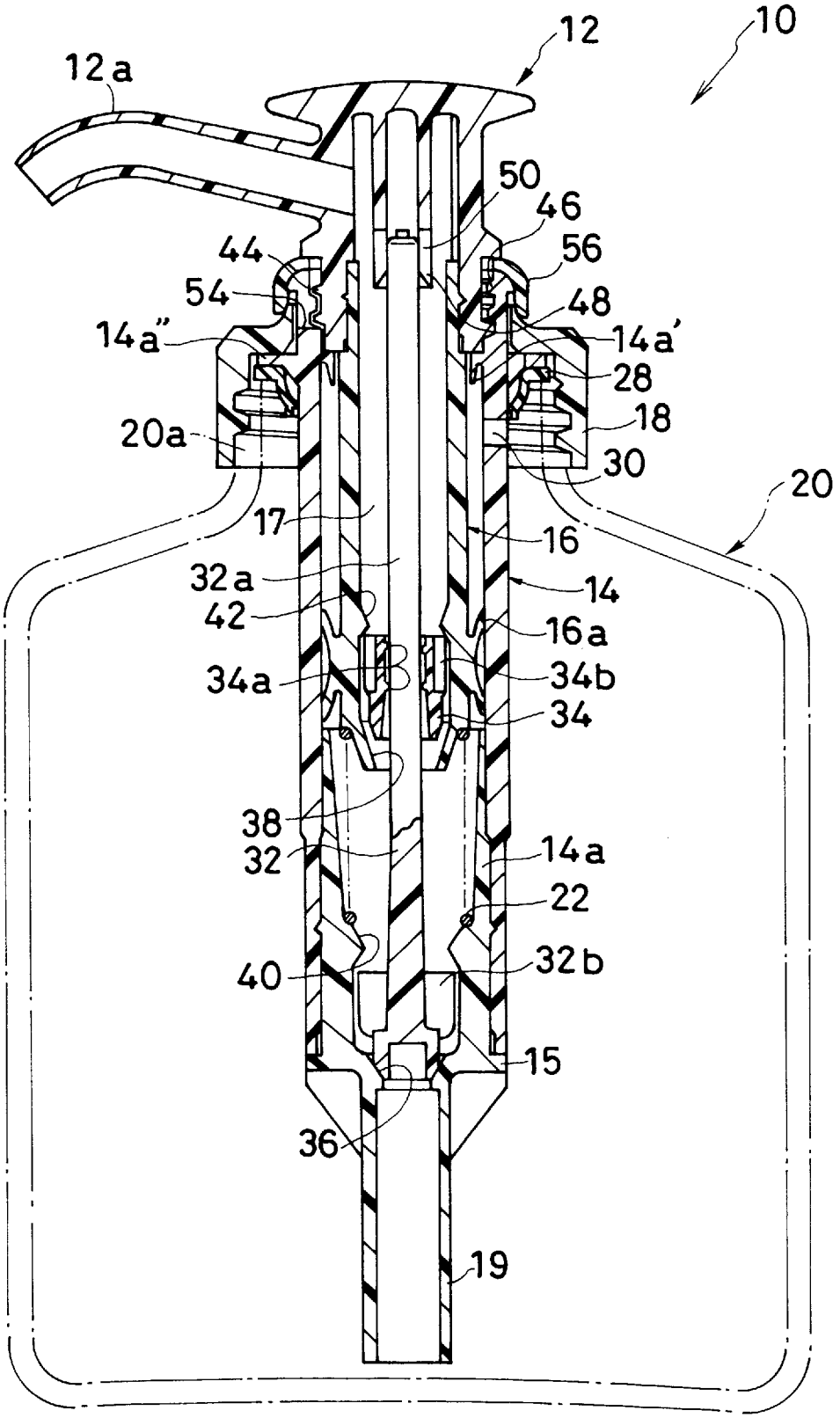
FIG. 4 is a longitudinal sectional view of the first embodiment, showing the nozzle head held at its lowest position.

When the nozzle head 12 is held at its lowest position shown in FIG. 4, the primary valve 32 is steadfastly held at the closed position by the valve holder 48 formed integral with the nozzle head 12. As long as the primary valve 32 is held at the closed position, it prevents the liquid from leaking while the dispenser-container unit is being transported or displayed.

Since the valve holder 48 can expand and contract in its radial direction, it can hold the primary valve 32 at different positions in vertical direction. Thus, even if the valve 32 is shorter or longer than the design length or is arranged, by error, at a wrong position, the valve holder 48 can reliably hold the valve 32 at the closed position when the nozzle head 12 is held at its lowest position.

The valve holder 48 has a plurality of vertical slits 50 which are spaced apart at angular intervals. The valve holder 48 may have more or less slits, for example only one slit. No matter how many slits it has, the valve holder 48 can expand and contract in the radial direction.

It is sufficient for the valve holder 48 to set the primary valve 32 into contact with the valve seat 36, thereby closing the primary valve 32, when the nozzle head 12 is held at its lowest position shown in FIG. 4. Only if the valve holder 48 thus closes the primary valve 32, it need not be suspended from the top of the nozzle head 12 as shown in FIGS. 1, 3 and 4. Instead, it may be suspended from the lower end of the piston 16 as illustrated in FIG. 5.

Figure 5:
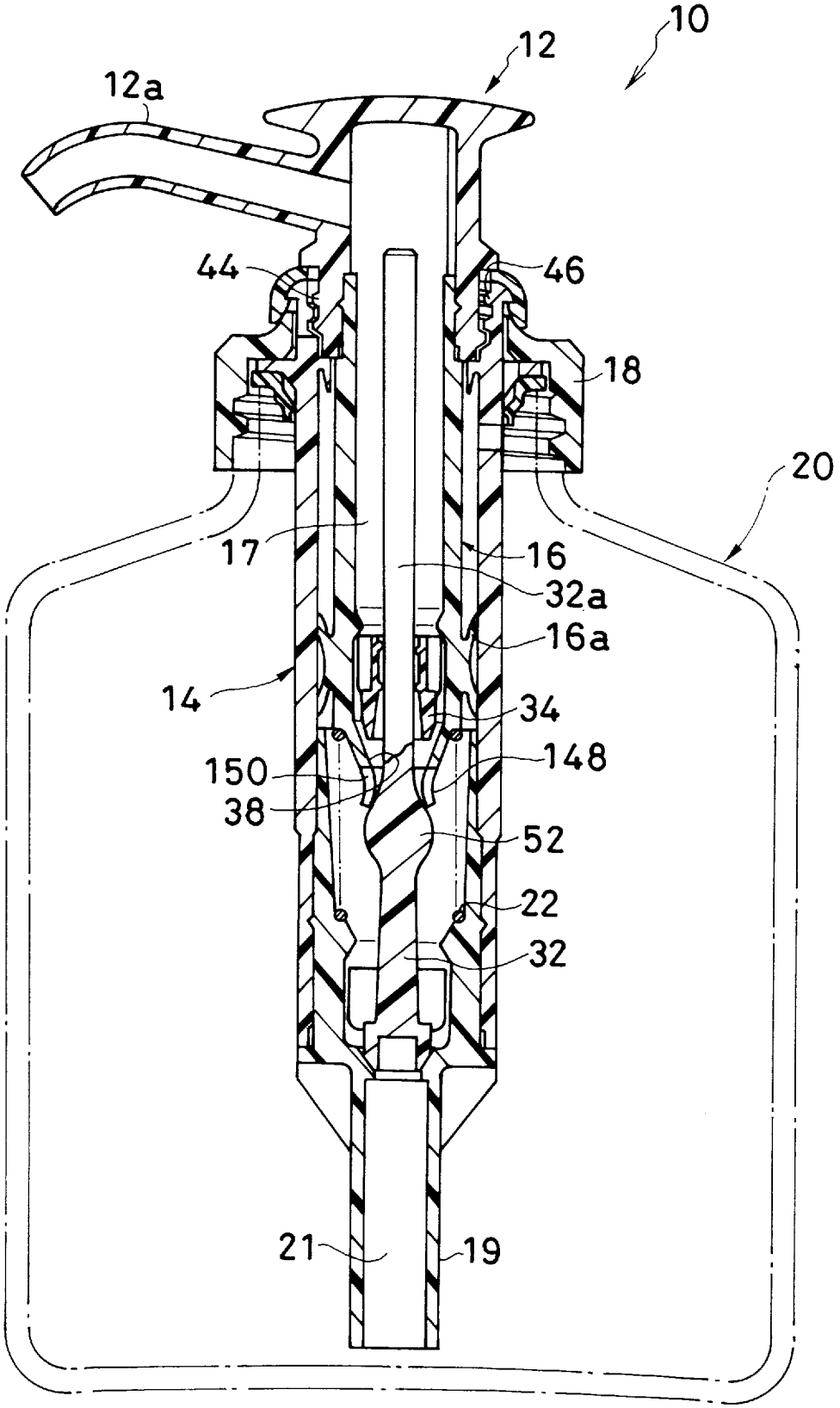
FIG. 5 is a longitudinal sectional view of a first modification of the first embodiment, showing the nozzle head held at its lowest position.

As shown in FIG. 5, the rod-shaped primary valve 32 has a bulbous intermediate portion 52, and the valve holder 148 suspended from the lower end of the piston 16 has a plurality of vertical slits 150. The slits 150 opens at the lower end of the holder 148 and spaced apart along the circumference of the holder 148 at angular intervals. The valve holder 148 reliably holds the primary valve 32 at the closed position when the nozzle head 12 is pushed down to the lowest position As long as the primary valve 32 is held at the closed position, it prevents the liquid from leaking while the dispenser-container unit is being transported or displayed. Needless to say, the valve holder 148 made elastic can hold the valve 32 at the closed position even if the valve 32 is shorter or longer than the design length or is arranged, by error, at a wrong position.

It suffices for the valve holder 148 to have at least one slit 150. Nonetheless, it is desired that the valve holder 148 have two or more slits 150 spaced at angular intervals, each being wide enough to act as a fluid passage for smoothly guiding the liquid into the piston 16.

Figure 6:
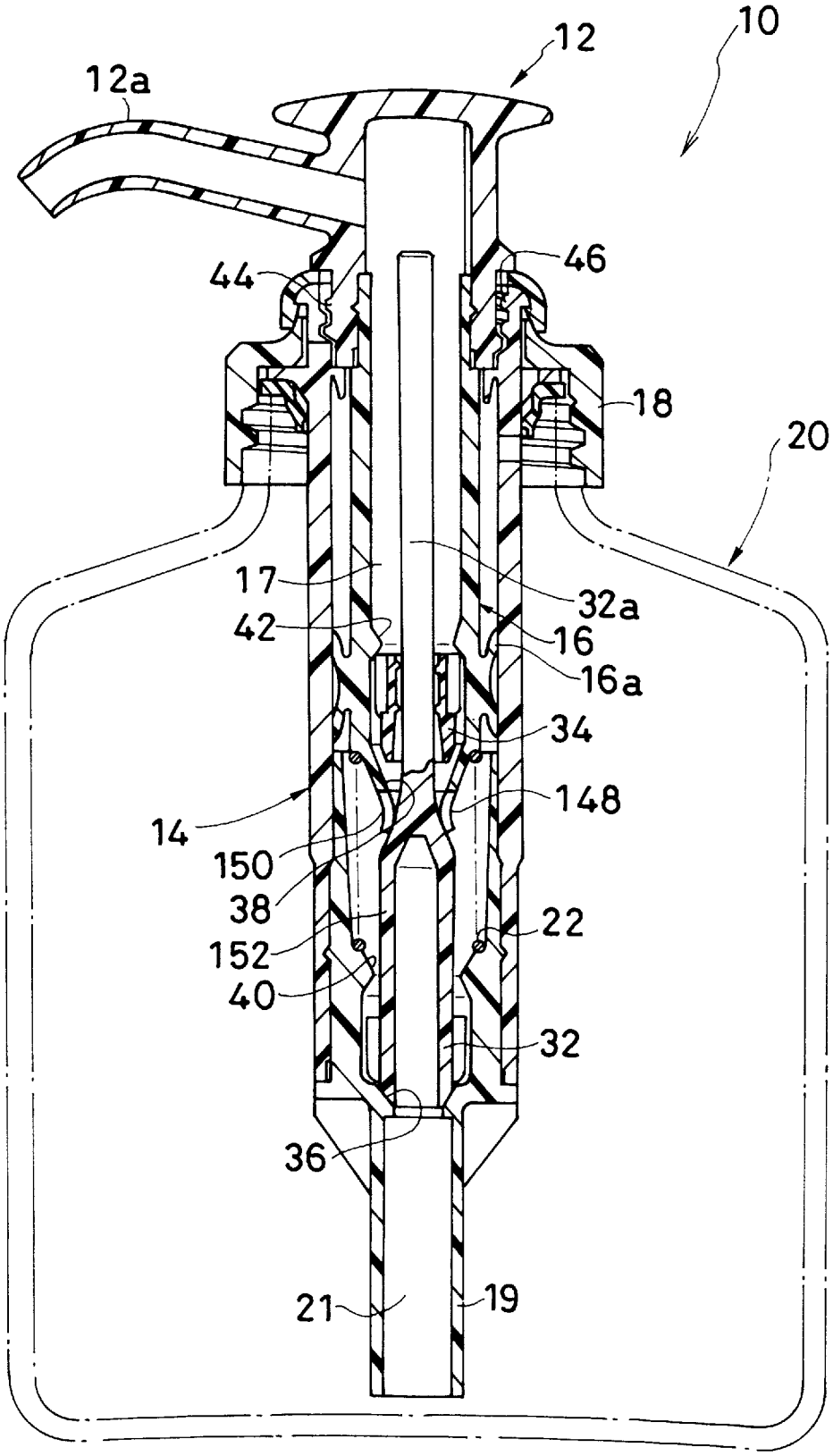
FIG. 6 is a longitudinal sectional view of a second modification of the first embodiment, showing the nozzle head held at its lowest position.

The primary valve 32 may have a thick lower end portion 152 as shown in FIG. 6, rather than having a bulbous intermediate portion 52 as illustrated in FIG. 5. In this case, the mold for forming the primary valve 32 can be simple in design and can thus be made at low cost.

Figure 2:
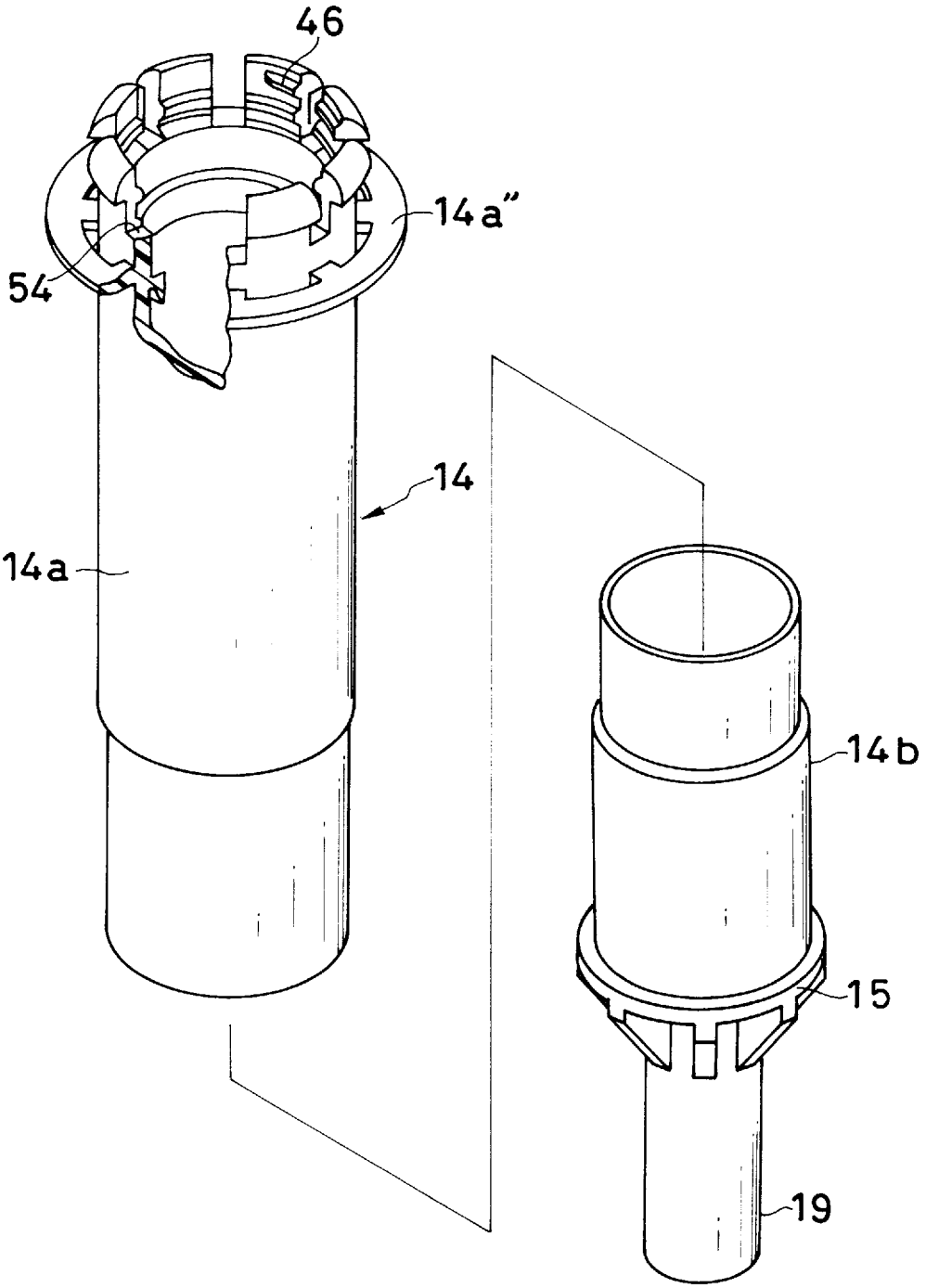
FIG. 2 is an exploded perspective view of the cylinder of the first embodiment.

As seen from FIGS. 1 and 2, the cylinder 14 has a plurality of vertical slits 54 in the upper end portion, each opening at the upper end of the cylinder 14. The slits 54 are spaced at angular intervals in the circumferential direction of the cylinder 14.

The upper end portion of the cylinder 14, in which the female screw 46 is formed, can elastically expand in the radial direction Hence, the female-screw core can be pulled out without being rotated from a mold in the process of injection-molding the cylinder 14. The mold for forming the cylinder 14 can thus be simple in structure and made at a low cost. Further, injection-molded in a mold of a simple structure, the cylinder 14 can be manufactured within a short time.

Having the slits 54, the upper end portion of the cylinder 14 can be elastically deformed. The male screw 44 may therefore come out of mesh with the female screw 46 when the nozzle head 12 is forcibly pulled upwards to expand the upper end portion of the cylinder 14 in the radial direction Nevertheless, this would not happen. This is because a cylinder cap 56 is mounted on the upper end portion of the cylinder 14 as shown in FIG. 1 before the dispenser 10 is coupled to the container 20. The cap 56 prevents the upper end portion of the cylinder 14 from expanding in the radial direction.

The cylinder cap 56 is snap-fitted on the upper end portion of the cylinder 14 This is achieved by the engagement between a hook formed integral with the cylinder 14 and a hook formed integral with the cylinder cap 56. The engagement means is not limited to the hooks. Rather, it may be a combination of an annular groove and an annular projection.

In the first embodiment of the invention, shown in FIGS. 1 to 6, the secondary valve 34 is mounted on the rod-shaped primary valve 32 and put in frictional contact with the primary valve 32. The primary valve 32 and the secondary valve 34 therefore operate in interlock; the former is opened with a delay after the latter is closed when the nozzle head 12 starts moving upwards. The secondary valve 34 need not be mounted on the primary valve 32, however.

A push-type dispenser 110 in which the primary and secondary valves are arranged, end to end, and which is the second embodiment of the present invention will now be described, with reference to FIGS. 7, 8 and 9. In the second embodiment, the primary valve 132 kicks down the secondary valve 134, whereby the valves 132 and 134 operate m interlock.

Figure 7:
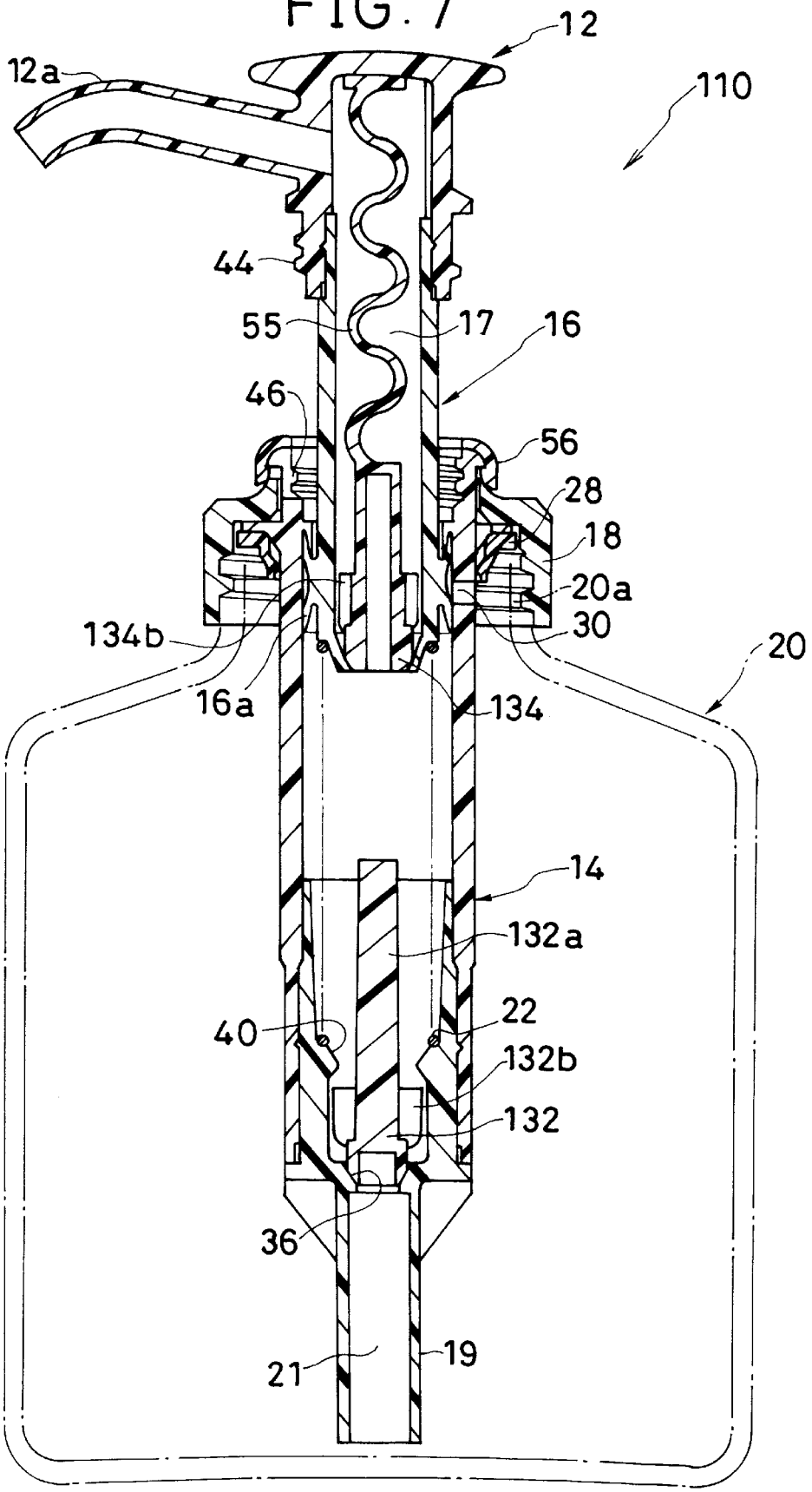
FIG. 7 is a longitudinal sectional view of a push-type dispenser according to a second embodiment of the invention, showing the nozzle head located at its upper position.

As shown in FIG. 7, the primary valve 132 has a rod 132*a* and is located in the cylinder 14 to regulate the flow of a liquid through the supply path 21, as in the first embodiment (FIGS. 1 to 6). The secondary valve 134 is arranged in the piston 16 to regulate the flow of the liquid in the discharge path 17.

In the push-type dispenser 110, a valve spring 55 pushes the secondary valve 134 onto the valve seat 38, placing the valve 134 in the closed position. The valve spring 55 is a waving compression spring. It is made of plastic, formed integral with the secondary valve 134 and extends upwards from the top of the secondary valve 134. The upper end portion of the spring 55 is a plate-like stopper, which abuts on the inner surface of the top of the nozzle head 12.

The rod 132*a* has such a diameter that it can be inserted into the piston 16. It has such a length that it abuts on the lower end of the secondary valve 134, pushing the valve 134 upwards and opening the same, when the piston 16 is pushed down to the lower position The primary valve 132 has integral guide plates 132*b*, and the secondary valve 134 has integral guide plates 134*b*. Provided above the guide plates 132*b* is a stopper 40 which prevents the primary valve 132 from moving upwards. The stopper 40 is formed integral with the inner surface of the valve base 14*b*. A stopper need not be provided for the secondary valve 134 since the valve spring 55 applies a biasing force on the secondary valve 134, pushing the same toward the valve seat 38.

Figure 8:
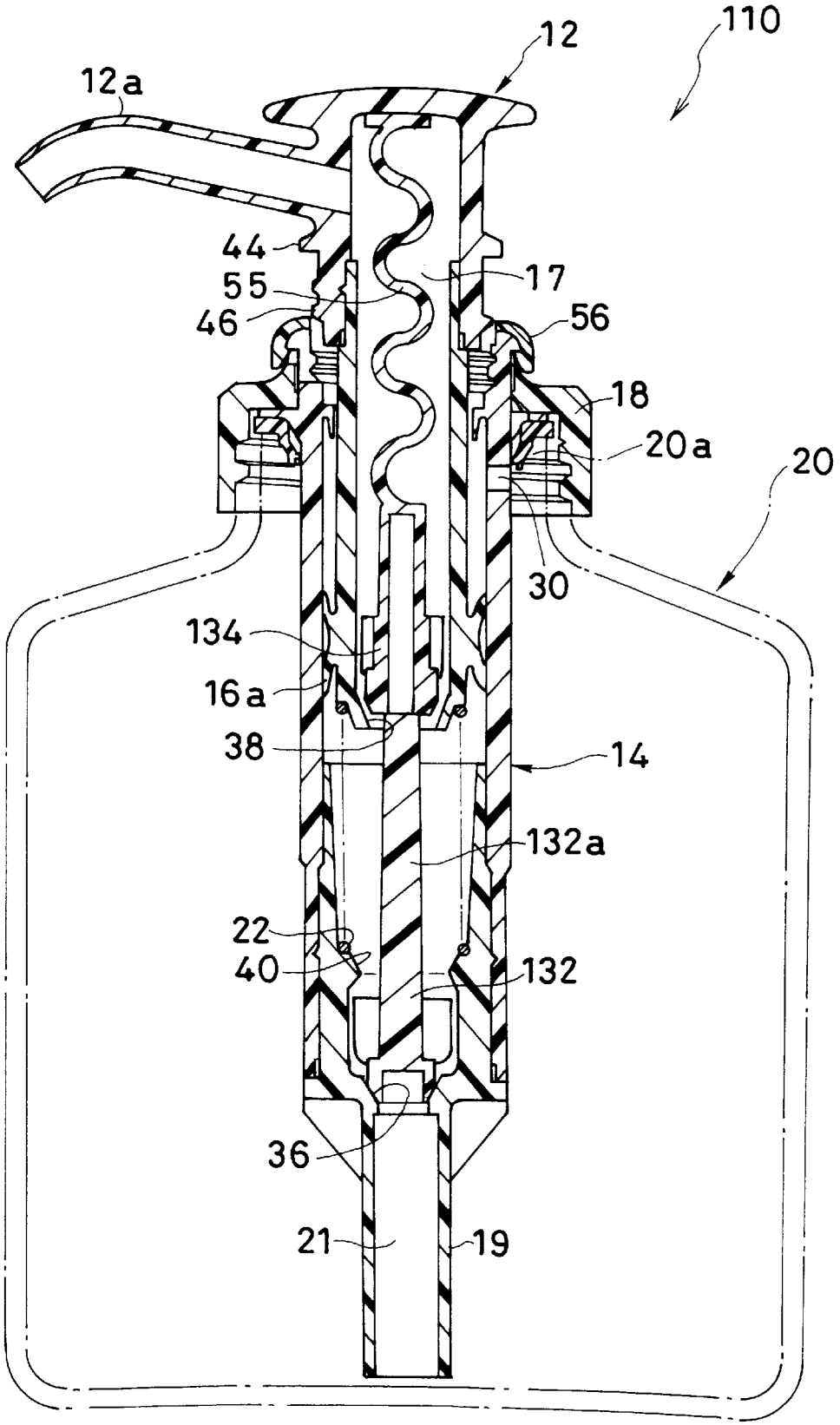
FIG. 8 is a longitudinal sectional view of the second embodiment, showing the nozzle head located at its lower position.

When a user pushes down the nozzle head 12 to the lower position as shown in FIG. 8, the upper end of the primary valve 132 kicks the lower end of the secondary valve 134. The secondary valve 134 is thereby opened.

When the user releases the nozzle head 12, the piston 16 begins moving upwards due to the biasing force of the return spring 22. The piston 16 keeps moving up, not accompanied by the secondary valve 134, until the valve seat 38 abuts on the secondary valve 134. When the valve seat 38 abuts on it, the secondary valve 134 is closed. Thereafter, the secondary valve 134 moves up together with the piston 16.

While the piston 16 is moving up, not accompanied by the secondary valve 134, the valve spring 55 keeps pushing the primary valve 132 onto the valve seat 36. Thus, the primary valve 132 remains closed.

As the secondary valve 134 moves up along with the piston 16, the secondary valve 134 leaves the primary valve 132. The biasing force of the valve spring 55 is no longer applied to the primary valve 132. As the piston 16 further moves up, accompanied by the secondary valve 134, a negative pressure is generated in the cylinder 14, moving the primary valve 132 from the valve seat 36.

In the push-type dispenser 110 according to the second embodiment, too, the secondary valve 134 is closed as the piston 16 moves upwards alone, not accompanied by the secondary valve 134, and the primary valve 132 is not opened at all unless the secondary valve 134 moves up together with the piston 16 after it is closed. In other words, the primary valve 132 is opened with a delay after the secondary valve 134 is closed.

Since the secondary valve 134 is closed some time after the nozzle head 12 starts moving upwards and the primary valve 132 is opened some time after the secondary valve 134 is closed, the liquid flows from the discharge path 17 back into the cylinder 14. That is, back suction takes place. The back suction prevents the liquid from solidifying at the distal end of the nozzle 12*a,* ultimately ensuring smooth discharge of the liquid from the nozzle 12*a.*

The dispenser 110 is more simple in structure than the dispenser 10 (FIGS. 1 to 6). Nonetheless, while the nozzle head 12 is moving upwards, the piston 16 can move up for some distance before the secondary valve is closed and the primary valve is opened after the secondary valve is closed, exactly in the same way as in the dispenser 10 according to the first embodiment.

When the nozzle head 12 is pushed down and turned, the male screw 44 and the female screw 46 mesh with each other. As a result, the nozzle head 12 is held at its lowest position as shown in FIG. 9. Once the head 12 is held at the lowest position, the biasing force of the valve spring 55 is transmitted via the secondary valve 134 to the primary valve 132. The primary valve 132 is thereby pushed onto the valve seat 36 and is closed completely.

Like the dispenser 10 (i.e., the first embodiment), the dispenser 110 can have its height reduced by holding the nozzle head 12 at the lowest position This helps to reduce the space which the dispenser 110 or the unit comprising the dispenser 110 and the container 20 occupies while being transported or displayed. Moreover, this reliably prevents the liquid from leaking while the dispenser-container unit is being transported or displayed.

Figure 9:
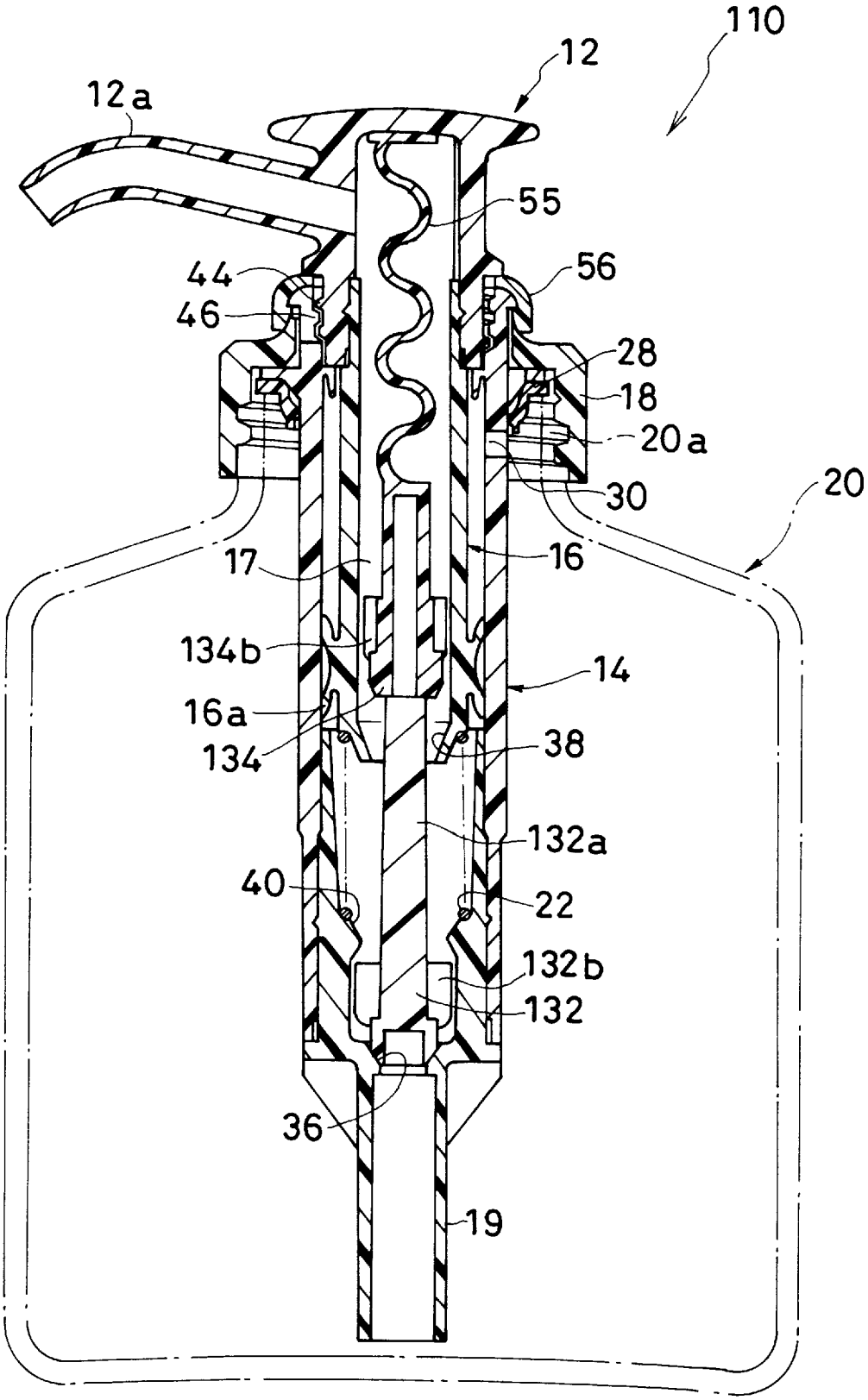
FIG. 9 is a longitudinal sectional view of the second embodiment, showing the nozzle head held at its lowest position.
Figure 10B:
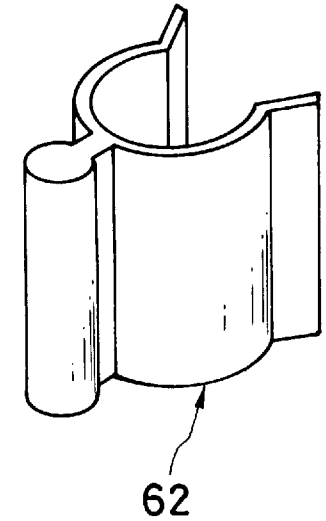
FIG. 10B is a perspective view of the stopper illustrated in FIG. 10A.
Figure 10A:
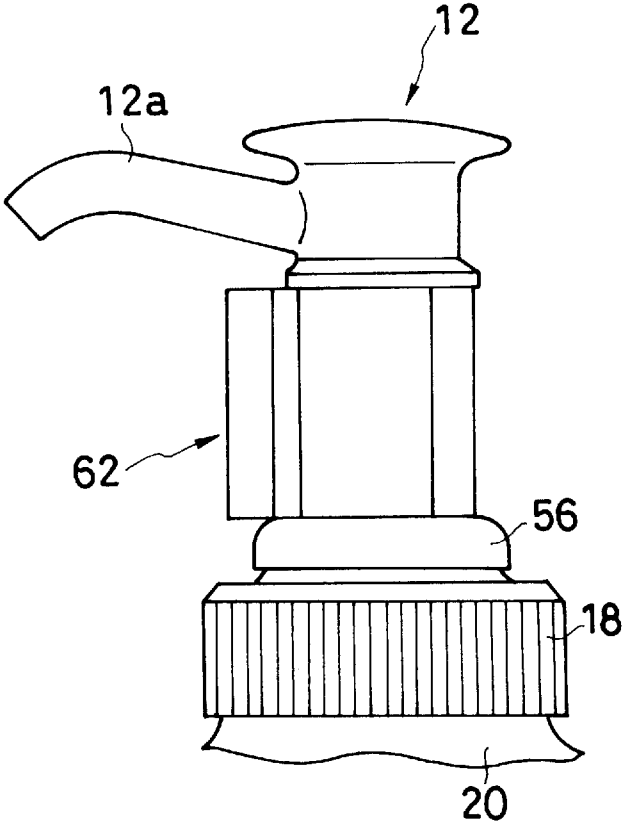
FIG. 10A is a fragmentary elevational view of a first modification of the second embodiment, showing the nozzle head held at its upper (initial) position.

If a sufficient space is available for the push-type dispenser 110 or the dispenser-container unit, it is unnecessary to hold the nozzle head 12 at its lowest position (FIG. 9). Rather, the head 12 may be held at its upper (initial) position by means of a stopper 62, as illustrated in FIG. 10A As better seen from FIG. 10B, the stopper 62 is generally a hollow cylinder having an open vertical slit. As long as the stopper 62 is mounted on the nozzle head 12, between the nozzle head 12 and the cylinder cap 56, the nozzle head 12 remains held at the initial position (FIG. 7). The liquid is thereby prevented from leaking while the dispenser-container unit is being transported or displayed. If the stopper 62 is used, it is unnecessary to provide the male screw 44 and the female screw 46 on the nozzle head 12 and the cylinder 14, respectively.

Figure 11B:
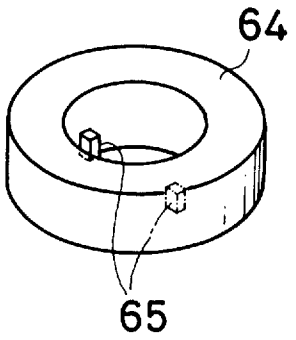
FIG. 11B is a perspective view of the chaplet shown in FIG. 11A.
Figure 11A:
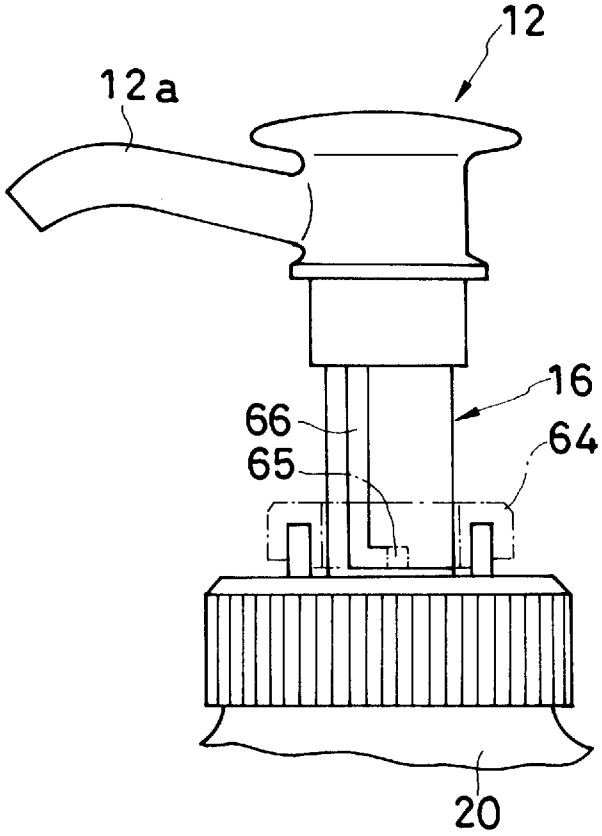
FIG. 11A is fragmentary elevational view of a second modification of the second embodiment, showing the nozzle head held at its upper (initial) position.

Furthermore, the cylinder cap 56 may be replaced by a chaplet 64 as illustrated in FIG. 11A As seen from FIG. 11A, the chaplet 64 is a ring mounted the upper end portion of the cylinder 14, prohibiting the nozzle head 12 from moving downwards.

As shown in FIG. 11B, the chaplet 64 has a pair of projections 65 formed integral with the inner circumferential surface. The upper end portion of the piston 16 has a pair of lishaped guide grooves 66 cut in its outer circumferential surface. Each guide groove 66 consists of a vertical part and a horizontal part which extends from the lower end of the vertical part. The chaplet 64 is mounted on the upper end portion of the cylinder 14, with the projections 65 slidably fitted in the guide grooves 66. The piston 16 can move up and down together with the nozzle head 12 as long as the projections 65 remain in the vertical parts of the guide grooves 66. Once the piston 16 is turned, fitting the projections 65 into the horizontal parts of the guide grooves 66, the piston 16 can no longer move vertically. As a result, the nozzle head 12 is held at its upper (initial) position The liquid is thereby prevented from leaking while the dispenser-container unit is being transported or displayed.

Each of the guide grooves 66 may consist of a vertical part and a horizontal part which extends from the upper end of the vertical part, not from the lower end thereof as shown in FIG. 11A In this case, the nozzle head 12 will be held at the lower position as in the first embodiments (FIGS. 1 to 6) if the nozzle head 12 is moved down until the projections 65 abut on the upper ends of the vertical parts of the respective guide grooves 66 and is then turned, fitting the projections 65 into the horizontal parts of the respective guide grooves 66.

As described above, in the push-type dispenser according to the invention, the secondary valve is closed with a delay after the nozzle head starts moving up and the primary valve is opened with a delay after the secondary valve is closed, not influenced by the weight of the secondary valve, the viscosity of the liquid and the specific gravity of the liquid. The residual liquid therefore flows from the discharge path back into the cylinder through the secondary valve before the primary valve is opened, due to the negative pressure generated in the cylinder by the upward motion of the piston In short, back suction is accomplished, whereby the residual liquid is reliably forced back into the cylinder before the liquid is sucked up from a container into the cylinder, irrespective of the weight of the secondary valve, the viscosity of the liquid and the specific gravity thereof.

Since the residual liquid flows back from the distal end of the nozzle, its foremost part is not directly exposed to air, prevented from drying or solidifying. This ensures smooth discharge of the liquid from the nozzle.

Further, the liquid is prevented from dribbling from the nozzle. Dribbling is reliably prevented because the nozzle is bent at the middle, with the proximal end portion inclined upward and the distal end portion inclined downwards, and because the residual liquid is forced back until its foremost part passes the junction between the proximal and distal end portions of the nozzle.

Still further, since the secondary valve is mounted on the rod-shaped primary valve and can be held at an opened position, the piston 16 can move up for some distance before the secondary valve is closed and the primary valve is opened after the secondary valve is closed, without requiring a complex mechanism, while the nozzle head is moving upwards.

The upper end of the primary valve kicks the lower end of the secondary valve as the piston is moved down when a user pushes down the nozzle head to the lower position, thereby opening the secondary valve at desired timing, without requiring a complicated mechanism.

The nozzle head can be held at its lowest position by setting the male screw formed on the nozzle head into mesh with the female screw formed on the cylinder, whereby the valve holder holds the primary valve in contact with the valve seat, closing the primary valve. Once the nozzle head is held at the lowest position, the height of the dispenser or the height of the dispenser-container unit is deceased. This helps to reduce the space the dispenser or the dispenser-container unit occupies while being transported or displayed.

The valve holder is provided at the inner surface of the top of the nozzle head or at the lower end of the piston. It has vertical slits and can therefore elastically expand and contract in the radial direction The valve holder can therefore hold the primary valve at a desired position even if the rod-shaped primary valve is shorter or longer than the design length or is arranged at a wrong position Hence, the primary valve can reliably held at its closed position.

Having the vertical slits spaced at angular intervals, the upper end portion of the cylinder having the female screw on it can be elastically deformed. This makes it possible to pull out the female-screw core can be pulled out without being rotated from a mold in the process of injection-molding the cylinder. The mold for forming the cylinder can thus be simple in structure and made easily.

What is claimed is:

1. A dispenser comprising:

a cylinder;

a bottle cap for coupling the cylinder to a mouth of a container filled with a liquid;

a suction tube connected to a lower end of the cylinder and defining a supply path for supplying the liquid from the container into the cylinder;

a primary valve provided in the cylinder, for regulating a flow of the liquid from the container into the cylinder through the suction tube;

a piston capable of reciprocating and sliding in the cylinder, for sucking up the liquid from the container into the cylinder through the primary valve and pressuring the liquid in the cylinder;

a return spring biasing the piston upwards in the cylinder;

a nozzle head having an integral projecting nozzle, secured to an upper end of the piston, and capable of being pushed down against a biasing force of the return spring, together with the piston; and a secondary valve for regulating a flow of the liquid from the cylinder into a discharge path defined by the piston and the nozzle, wherein the primary valve has a rod extending through the piston; the secondary valve is arranged in the piston interlocked with the primary valve; and wherein a stopper is mounted on the piston and located above the secondary valve, for kicking the secondary valve, releasing the same from interlock with the primary valve and allowing the same to move downwards together with the piston; such that the secondary valve is closed with a delay after the nozzle head starts moving upward together with the piston, by virtue of the biasing force of the return spring; and such that the primary valve is prevented from opening until the secondary valve is closed, thereby to suck residual liquid back into the cylinder from the discharge path.

2. The dispenser according to claim 1, wherein the secondary valve has a seal member formed on an inner circumference thereof, set in sliding contact with the primary valve and is mounted on the primary valve to move up and down along with the primary valve, by virtue of friction between the seal member and the primary valve.

3. The dispenser according to claim 1, wherein the nozzle is bent at a middle portion, with a proximal portion inclined upward and a distal end portion inclined downwards.

4. The dispenser according to claim 2, wherein the nozzle is bent at a middle portion, with a proximal portion inclined upward and a distal end portion inclined downwards.

5. The dispenser according to claim 2, wherein a female screw is formed in an inner surface of an upper end portion of the cylinder and a male screw is formed in an outer surface of the nozzle head, the nozzle head is held at a lowest position and secured to the cylinder by setting the male screw into mesh with the female screw, and a valve holder pushes the primary valve onto the valve seat, thereby closing the primary valve.

6. The dispenser according to claim 2, wherein a valve holder is provided at an inner surface of a top of the nozzle head, extends downwards, pushes the primary valve onto a valve seat when the nozzle head is pushed to a lowest position and has at least one slit to be elastically deformed in a radial direction on a lower end portion of the valve holder.

7. The dispenser according to claim 3, wherein a valve holder is provided at an inner surface of a top of the nozzle head, extends downwards, pushes the primary valve onto a valve seat when the nozzle head is pushed to lowest position and has at least one slit to be elastically deformed in a radial direction on a lower end portion of the valve holder.

8. The dispenser according to claim 2, wherein the primary valve has a bulbous intermediate portion, a valve holder extends downwards from a lower end of the piston, abutting on the bulbous intermediate portion so as to push the primary valve onto a valve seat when the nozzle head is pushed to a lowest position, and a lower end portion of the valve holder has at least one slit to be elastically deformed in a radial direction.

9. The dispenser according to claim 3, wherein the primary valve has a bulbous intermediate portion, a valve holder extends downwards from a lower end of the piston, abutting on the bulbous intermediate portion so as to push the primary valve onto a valve seat when the nozzle head is pushed to a lowest position, and a lower end portion of the valve holder has at least one slit to be elastically deformed in a radial direction.

10. The dispenser according to claim 2, wherein a lower half of the primary valve is a hollow cylinder having a diameter greater than an upper half a valve holder extends downwards from a lower end of the piston, abutting on the lower half of the primary valve so as to push the primary valve onto a valve seat when the nozzle head is pushed to a lowest position, and a lower end portion of the valve holder has at least one slit to be elastically deformed in a radial direction.

11. The dispenser according to claim 3, wherein a lower half of the primary valve is a hollow cylinder having a diameter greater than an upper half, a valve holder extends downwards from a lower end of the piston, abutting on the lower half of the primary valve so as to push the primary valve onto a valve seat when the nozzle head is pushed to a lowest position, and a lower end portion of the valve holder has at least one slit to be elastically deformed in a radial direction.

12. The dispenser according to claim 1, wherein the secondary valve has a seal member formed on an inner circumference thereof, set in sliding contact with the primary valve and is mounted on the primary valve to move up and down along with the primary valve, by virtue of friction between the seal member and the primary valve, the nozzle is bent at a middle portion, with a proximal portion inclined upward and a distal end portion inclined downwards, an upper end portion of the cylinder has a plurality of vertical slits, each opening at the upper end of the cylinder, enabling the upper end portion of the cylinder to be deformed in a radial direction, a cylinder cap is mounted on the upper end portion of the cylinder, preventing the upper end portion thereof from expanding in the radial direction.

13. The dispenser according to claim 1, wherein the secondary valve has a seal member formed on an inner circumference thereof, set in sliding contact with the primary valve, is mounted on the primary valve to move up and down along with the primary valve, by virtue of friction between the seal member and the primary valve, the nozzle is bent at a middle portion, with a proximal portion inclined upward and a distal end portion inclined downwards, a female screw is formed in an inner surface of an upper end portion of the cylinder and a male screw is formed in an outer surface of the nozzle head, the nozzle head is held at a lowest position and secured to the cylinder by setting the male screw into mesh with the female screw, and a valve holder pushes the primary valve onto the valve seat, thereby closing the primary valve.

* * * * *